United States Patent [19]

Siccone

[11] 4,348,552

[45] Sep. 7, 1982

[54] DIRECT/REFLECTING SPEAKER SYSTEM AND TRIANGULAR SHAPED ENCLOSURE

[76] Inventor: Ralph R. Siccone, 474 Barretts Mill Rd., Concord, Mass. 01742

[21] Appl. No.: 157,712

[22] Filed: Jun. 9, 1980

[51] Int. Cl.[3] ..... H04R 1/20; H04R 5/02

[52] U.S. Cl. ..... 179/1 E; 179/1 GA; 181/147

[58] Field of Search ..... 179/1 E, 1 GA; 181/144–147

[56] References Cited

U.S. PATENT DOCUMENTS

| | | | |
|---|---|---|---|
| 2,814,354 | 11/1957 | Brettell | 181/147 |
| 3,627,948 | 12/1971 | Nichols | 179/1 GA |
| 4,051,919 | 10/1977 | Buettner | 179/1 E |
| 4,073,365 | 2/1978 | Johnson | 181/147 |
| 4,179,585 | 12/1979 | Herrenschmidt | 179/1 E |
| 4,249,037 | 2/1981 | Dexter | 179/1 E |

FOREIGN PATENT DOCUMENTS

| | | | |
|---|---|---|---|
| 2631371 | 1/1978 | Fed. Rep. of Germany | 179/1 E |

*Primary Examiner*—George G. Stellar

*Attorney, Agent, or Firm*—Herbert L. Gatewood

[57] ABSTRACT

A loud speaker system of simple, compact and economical design is provided, using a minimum of space and being suitable for exact corner placement. The loud speaker system provides spacious, room filling sound, and excellent stereo imagery. Its design concept uses the listening room walls to extend system frequency response, wide dispersion, and stereo imaging. The loud speaker system functions well over substantially the complete sound spectrum, despite the fact that its triangular-shaped enclosure is provided with only a single, relatively small, speaker on each of its vertically disposed panels.

16 Claims, 7 Drawing Figures

DIRECT/REFLECTING SPEAKER SYSTEM AND TRIANGULAR SHAPED ENCLOSURE

BACKGROUND OF THE INVENTION (1) Field of the Invention

This invention relates, in general, to a loud speaker system and, more particularly, to a direct/reflecting speaker system incorporating a triangular-shaped enclosure enabling its exact placement in the corners of a listening room.

(2) Description of the Prior Art

In sound reproduction systems utilizing loud speakers it is, of course, desirable that the sound be produced with the utmost possible realistic effect. However, just as the size and shape of a performing hall affect the sounds created, several characteristics of the room where music is reproduced also affect the way that it sounds. The size of the room, its construction, and its furnishing can cause spectral imbalances by absorbing or exaggerating different frequencies in the music.

Given these variables, and because the last component in any audio system is a listening room, it is really impossible to design a speaker to work perfectly in every room. As a result, speaker designers have attempted to compensate with controls which affect the frequency response of the speakers by boosting or cutting the output of different drivers; however, the range of this type of control is severely limited by the frequency ranges of the different drivers.

Conventional speaker designs also attempt to compensate with various types of bass and treble controls. But these controls, designed according to standardized, easy-to-manufacture formulas, are simply inappropriate to cover the groups of frequencies in proportion necessary to control the many variables in room acoustics.

More recently speaker design has investigated the various critical aspects of room acoustics, and the lack of standardization in the recording industry as to variations in frequency response. As a result some speakers now are provided with controls to compensate for frequently occurring problems caused by room acoustics and recording techniques.

At a live performance, music which reaches one's ears comes not only directly from each instrument, but from every surface in the concert hall or the like which reflects the sound. The high proportion of reflected sound, as a matter of fact, is what gives a live performance its richness, depth, and spaciousness.

For a music system to more clearly recreate a live performance, it must be able to reproduce in one's listening room, the spatial image, i.e., the combination of direct and reflected sound, associated with a live performance. Nevertheless, up until only a few years ago, loud speaker systems conventionally radiated sounds almost totally direct. And full stereo sound could only be heard directly in front of, and between, a pair of speakers.

In U.S. Pat. No. 2,896,736, which issued July 28, 1959, to J. E. Karlson, there is disclosed an acoustic system involving a reflection type loud speaker. As disclosed in that patent, a sound reproducing loud speaker is located in an enclosure in such a manner that sound emanating therefrom is directed against a suitable wide sound reflecting surface. This surface, according to the patentee, can be either a flat or curved wall. Thus, a sound image is established which gives the impression to listeners of having emanated from substantially an entire reflecting wall, rather than the loud speaker itself. The sound, moreover, appears to have originated from some point beyond the reflecting wall and thus creates the effect of additional acoustic spaciousness. According to the patentee, however, the speaker enclosure must be spaced sufficiently from the wall that the reflected sound path completely avoids the loud speaker and its enclosure.

Although corner placement of the loud speaker in U.S. Pat. No. 2,896,736 is disclosed, and results in very interesting dual sound effects because each of the walls appear to be an individual sound, only a minor image effect, according to the patentee, is created. The composite effect is considerably different than when a single wall is used as the principal reflecting plane. Moreover, as disclosed in the patent, the corner placement of such a speaker system as disclosed produces less realistic and natural acoustic effects and should not be regarded as wholly equivalent to the use of a single reflecting wall.

While others than Karlson (U.S. Pat. No. 2,896,736) have heretofore disclosed speaker systems for corner placement in a listening room, none of them of which I am aware, including Karlson, have disclosed a direct-/reflecting speaker system, and exact corner placement, such as set forth herein. Moreover, none of the corner placement speaker systems invented before my invention, and of which I am aware, will provide the spaciousness of sound, as will my speaker system, while at the same time offering a speaker system that is not only economical but simple and compact in construction.

According to the disclosure in U.S. Pat. No. 3,923,124, the performance of most speakers is enhanced when the speaker is specifically designed for placement in the corner of a room. In such a design, according to the patentee, the speaker is usually triangular in shape, with the front panel facing outwardly into the room and side panels converging inwardly from the sides of the front panel to the back edge, or corner of the enclosure, facing the corner of the room. Two features of speaker response, according to the patentee, generally enhanced by corner placement of the speaker, are an improvement in bass response and an improvement in sound direction and dispersion in the listening room. Even so, the patentee fails to disclose whether such a corner placed speaker involves only direct sound, reflected sound, or a combination direct/reflected sound.

The speaker system actually disclosed in U.S. Pat. No. 3,923,124, while involving corner placement, is a backloaded folded horn comprising direct radiating low, mid-range, and high frequency drivers. The low frequency speaker is backloaded by the horn whose outlet faces into the corner of the room. The horn continues to expand from the horn outlet through a space between the side panels of the speaker enclosure and the walls forming the corner of the listening room, to the mouth of the horn at the front of the speaker enclosure.

In STEREO, Volume 10, No. 2, 1977, there is disclosed THE ALLISON: THREE System which, according to the author, is meant for corner placement, and moreover, whose efficiency and sound is augmented by the corner placement. This speaker system, as disclosed, comprises a 10-inch woofer, a $3\frac{1}{2}$-inch mid-range driver, and a 1-inch tweeter, all of which are located on the front face of the enclosure, which is of triangular-shaped cross-section, in, more or less, superposed fashion. Thus, the woofer is placed at the very bottom, roughly equidistant from the floor and walls, the mid-range driver is located about 31½-inches off the floor, and the tweeter just above that at 37⅛-inch height.

One of the problems with regard to corner placement of speakers, as set forth by the author in STEREO, is that with such a placement of the speakers one finds an absent or unstable center image-the so-called "hole-in-the-middle". However, quite advantageously and surprisingly, the author claims THE ALLISON: THREE Speaker System results in a very good center, indicating exceptionally good dispersion throughout the audible range.

The stereo image of THE ALLISON: THREE Speaker System moreover, is such that the sound appears to come from a broad region between the two speakers placed in the adjacent corners on the same wall in the listening room. Thus, the sound does not appear to come from the loud speakers at all. As a result, there is no "optimum listening area"; the listener location is not at all critical, as is the case in some stereo systems.

U.S. Pat. No. 3,983,333, which issued to Allison Acoustics, Inc. on Sept. 28, 1976, is believed to disclose, in FIG. 15 thereof, THE ALLISON: THREE Speaker System. As disclosed therein, in FIG. 15, the triangular-shaped speaker enclosure is located directly in the corner of the listening room, the sides of the speaker enclosure flush against the corner walls. Direct radiation audio reproducer means are mounted flush in the front panel of the speaker enclosure, the bass driver being located at the bottom, near the floor, and the middle and high frequency speakers located one above the other nearer the top of the enclosure.

The loud speaker system disclosed in U.S. Pat. No. 3,582,553 provides both direct and reflected sound to the listener so as to, according to the patentee, more nearly simulate the character of the sound heard in a concert hall. As disclosed in that patent, there is provided a loud speaker system which comprises an enclosure which comprises at least two normally rear baffles forming an angle with each other, and a front baffle which is situated normally parallel to a wall in a listening room. The rear baffles preferably contain a number of closely spaced, full-range, high compliance loud speakers which are connected in phase and nearly fill each rear baffle, and the front panel, preferably comprises a baffle containing at least one small loud speaker cophasally excited with certain of the other small loud speakers, for providing direct sound to the listener. Nevertheless, according to the patentee, an especially compact and inexpensive embodiment of the invention might include just one loud speaker on each rear baffle and one on the front baffle, with the front loud speaker energized through an attenuating network that delivers about 1¼ the high frequency energy to the front speaker than is delivered to each of the rear loud speakers. A feature of the invention resides in minimizing undesired resonances. Thus, there are a number of baffles each containing at least one loud speaker, but none of these baffles are parallel to another surface.

Although conceivably the loud speaker enclosure disclosed in U.S. Pat. No. 3,582,553 can be of triangular shape, there is no suggestion by the patentee that such a speaker system could actually be used in a corner placement. As a matter of fact, the speakers are only disclosed as being in spaced-location, about a foot from a wall of the listening room, and with the front baffle parallel to the wall, the loud speaker enclosure being located on the center line of the room. Where two speaker systems are used, the loud speaker enclosures are provided in spaced-apart location along one wall of the room, the front baffles of each speaker being in the same plane parallel to the said wall. Thus, corner placement would not be conceivably possible to accomplish the results intended by that patentee.

One of the principal problems encountered in designing a speaker system and enclosure for home use is optimizing design characteristics so as to reach a suitable compromise between two continuously conflicting design perimeters, one being the acoustic performance of the speaker and the other being aesthetic and financial considerations that place practical limitations on the size and the expense of any speaker system.

SUMMARY OF THE INVENTION

One of the primary objectives of this invention is to provide a loud speaker system that is not only of relatively simple and economical design but one that also provides sound equal to that produced by much larger and more expensive speaker systems.

By utilizing the corners of a listening room, it has been discovered that the size of the speaker system can be substantially reduced, as it uses a modified reflection principal to expand the limited bass response of a relatively small woofer.

Quite advantageously, the invention results in a speaker system of such small and compact size that it can be essentially hidden in the listening room so as not to be obtrusive. Nevertheless, while the invention provides a speaker enclosure that takes up a minimum of space in the listening room, the system still delivers room-filling sound of the highest fidelity. The speaker system enclosure is of low height, allows exact corner placement, and sits essentially directly on the floor.

Thus, in accordance with the basic aspects of my invention, there is provided a loud speaker system for exact corner placement in the listening room which comprises a triangular shaped enclosure of predetermined interior volume comprising first and second vertically disposed planar side panels intersecting with one another at a 90° angle, and a vertically disposed planar front panel intersecting said first and second side panels and subtending angles of 45°, a woofer for low frequency reproduction in one of said first and second side panels, a tweeter for high frequency sound reproduction in the said front panel, and a mid-range driver which reproduces the frequencies in between the woofer or low frequency driver and tweeter in the other of said first and second side panels, and a three-way electronic cross-over network electrically connected with the three speakers and having two desired cross-over points.

The design concept of the invention provides the high frequency range driver as a direct radiating speaker and the mid-range and low frequency range drivers as reflecting speakers, making use of the corner walls of the listening room as reflecting/sounding boards for dispersion and resonance. The mid-range and low frequency drivers must, to achieve the spacious and openness of sound desired, be mounted in the speaker enclosure in a particular relationship to one another, and to the tweeter. Thus, the speakers are mounted in such a fashion in the enclosure that, in the listening room, the mid-range driver will always be facing the back wall of the listening room, and the low frequency driver or woofer will be facing a side wall, a listener being located between and facing the wall between the two corner-placed speakers. Accordingly, for such an arrangement to exist, the two speakers used in the two adjacent corners of the listening room must be matched pairs, i.e., mirror images of one another as to location of the low frequency driver.

In use of the loud speaker system of the invention, it has been determined that the drivers in the side panels must be located a specific, predetermined distance from the corner walls, in the preferred embodiment disclosed herein, approximately four inches. With such a positioning of the speaker enclosure, sound emanating from the woofer and mid-range drivers appears to travel upwardly and along the walls. Quite surprisingly, when one is even standing directly in front of one of the matched pairs of speakers, sound can still be heard from the other speaker because of the excellent stereo imaging effect.

When matched pairs of loud speakers according to the invention are located in opposite corners, on the same side of the listening room, more than pleasing (and competitive with much larger and more expensive systems) sound reproduction will be achieved. The bass response will be found to deliver a rich, full, low end sound over substantially the entire intended functioning frequency spectrum. The middle and high end response will be found to be clean and crisp, open and bright. Spaciousness of sound results even in listening rooms of restricted size. Thus, one cannot readily tell where the sound is actually coming from.

Quite advantageously, no other speaker of the physical size of a speaker system according to the invention, and in its intended price range, approaches the sound reproduction achieved.

BRIEF DESCRIPTION OF THE DRAWING

The invention will be best understood in the following detailed description of a preferred embodiment thereof, taken in connection with the appended drawing in which.

DETAILED DESCRIPTION OF THE INVENTION AND THE PREFERRED EMBODIMENTS

Figure 1:
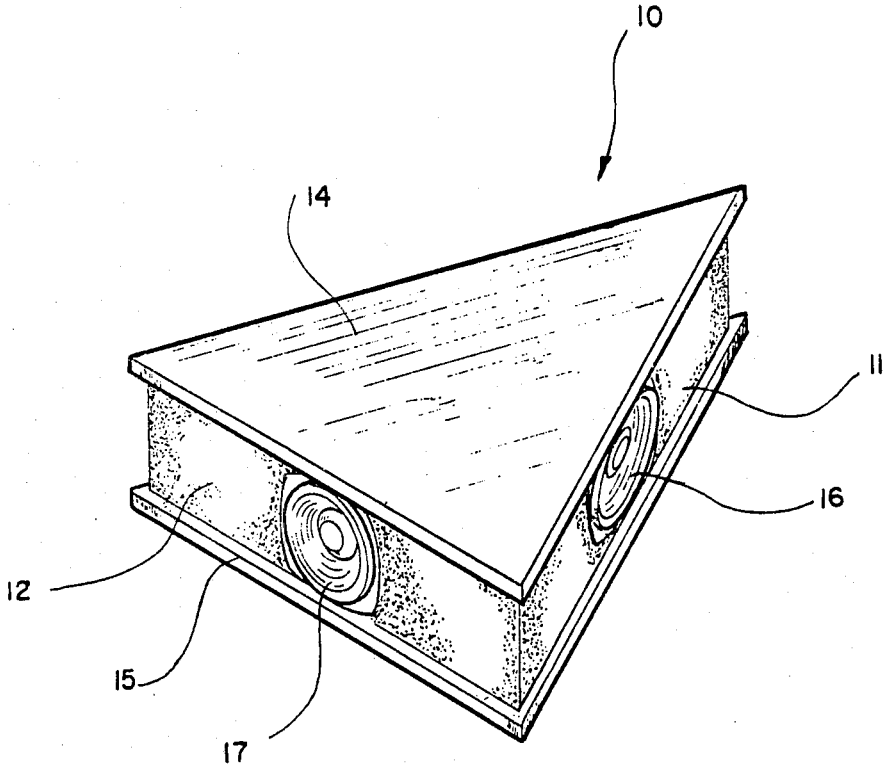
FIG. 1 is a perspective view of a corner placement loud speaker system in accordance with the invention.
Figure 2:
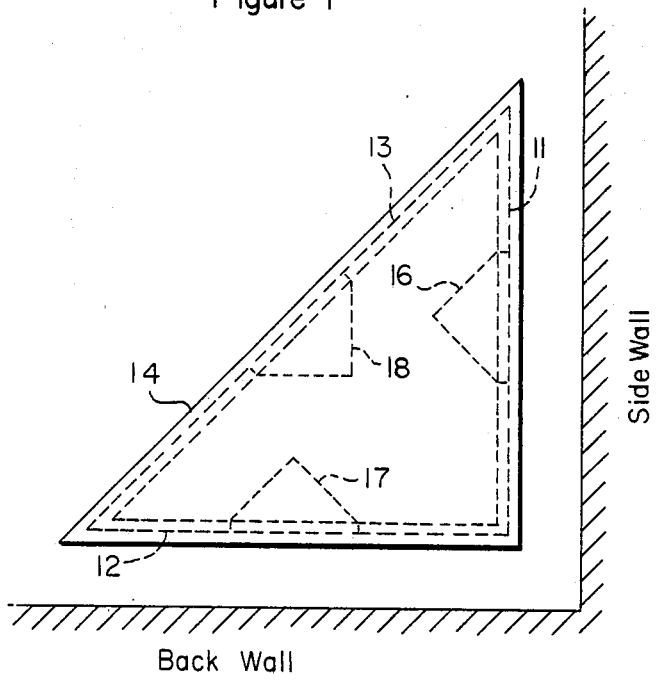
FIG. 2 is a top plan view of the loud speaker shown in FIG. 1.

Referring to the drawing, there is shown in FIG. 1 thereof, a triangular-shaped loud speaker enclosure 10 embodying the principals of the loud speaker system of the present invention which enclosure comprises first and second planar side panels 11, 12 disposed vertically and intersecting with one another at a 90° angle, and a vertically disposed planar front panel 13 (FIG. 2) which intersects with side panels 11, 12, subtending angles of 45°. Thus, side panels 11, 12 are of the same length. The speaker enclosure is completed, providing a relatively precise predetermined internal volume, a critical aspect of this invention, by planar top and bottom triangular-shaped panels 14, 15 which, as will be appreciated, are parallel with respect to one another. The side edges of the top and bottom panels, as shown more clearly in FIG. 2 of the drawing, intersect at a 90° angle, and the front edge intersects with the two side edges, subtending angles of 45°.

Figure 3:
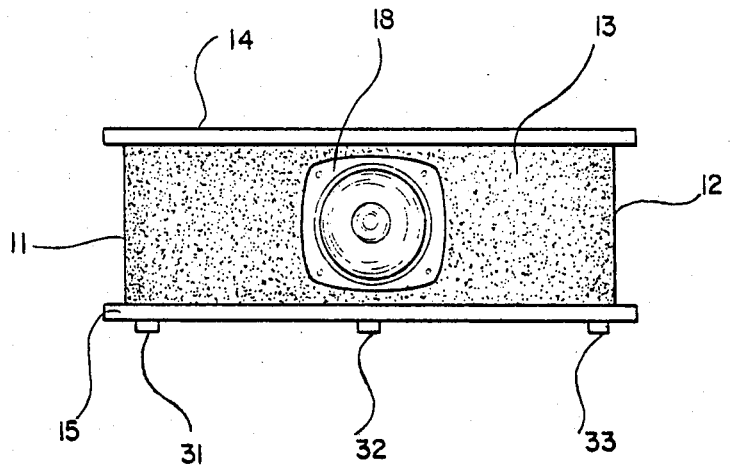
FIG. 3 is a side elevation of the speaker system shown in FIG. 1, looking at the front panel of the enclosure.

In each of the vertically disposed panels, as can be seen by reference to the drawing, in particular to FIGS. 1 and 3, are located suitable drivers 16, 17 and 18, as hereinafter more fully described, providing good sound reproduction over substantially the complete sound spectrum, despite the rather small dimensioned low frequency driver. These drivers are mounted centrally in each of the respective vertical panels, according to usual techniques, the driver face being located flush in each case with the outside surface of the respective panel.

While in the embodiment of the invention as shown in FIGS. 1, 2, 3 and 5 of the drawing, top and bottom panels 14, 15 are dimensioned so as to provide an overhang with respect to the perimeter defined by the vertically disposed panels, for a reason that will be more fully later discussed, these panels need not necessarily be so dimensioned. In another embodiment of the invention, top and bottom panels 14, 15 can be dimensioned so as to be co-extensive with the perimeter defined by the outside surfaces of the vertically disposed panels.

Figure 5:
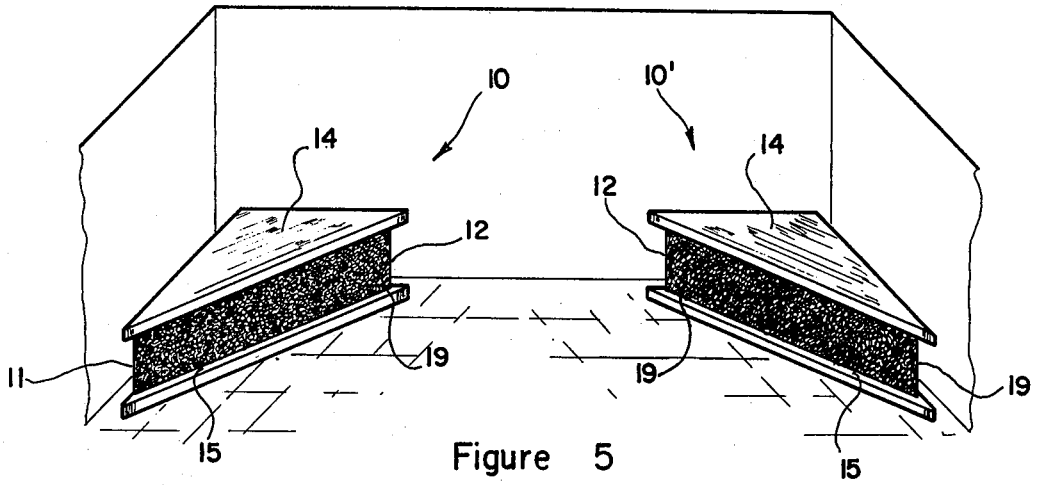
FIG. 5 is a view of a listening room showing matched pairs of speakers in accordance with the invention in use.

Although not shown in FIGS. 1 and 3 of the drawing, it will be appreciated that the outisde faces of vertically disposed side panels 11, 12 and front panel 13 are each covered with acoustic foam such as indicated by the acoustic foam grille 19 disclosed in FIG. 5. Various such foam materials commercially available will be found satisfactory in the practice of the invention; however, the acoustic foam grilles should preferably be of $\frac{3}{4}$-inch acoustic foam and be dimensioned to completely enclose the outside perimeter of the vertically disposed panels. In the case of the speaker enclosure such as shown in FIG. 1, top and bottom panels 14, 15 will overhang side panels 11, 12, 13 by about one inch, thereby providing the acoustic foam grilles flush with the perimeter defined by the top and bottom panels.

Of critical importance in the practice of the invention, in addition to the relatively precise interior volume of the enclosure and the distance of the drivers from the corner walls, are the location of the particular drivers with respect to one another, to provide not only room filling sound but excellent stereo imagery. Driver 18, which in use of the speaker system of the invention, always faces outwardly into the listening room, and is located in the front panel 13 of the speaker enclosure, reproduces the high frequency sounds. The performance of this driver should be characterized by a very wide frequency range, desirably a sound pressure frequency range of 1500–20,000 hz., smooth sound pressure response and excellent dispersion, high efficiency, high power handling capacity, and very low distortion. In the practice of the invention, a Peerless Model KO-lODT 1 inch voice coil dome tweeter has been found to meet the necessary requirements set forth. Such a driver has the following further specifications:

Magnet: 9 oz. ceramic
Voice Coil: 1 inch Aluminum Former
Impedence: 8 ohms
Resonant Frequency: 1000 $H_z$ Sensitivity: 92 dB SPL for 1 watt, 1M
Power Handling: 10 watt sine wave above 1500 $H_z$ Driver 17, located in vertical side panel 12, the panel facing the back wall of the listening room, must be the mid-range driver, and such a driver will be characterized by very linear frequency, preferably a sound pressure frequency range of 500–5000 $H_z$, low non-linear distortion, efficient sound dispersion, high efficiency, and low resonance frequency with adequate damping. The performance requirements will be satisfied by a Peerless K040 MRF 4-inch closed back driver whose further specifications are as follows:

Magnet: 9 oz. ceramic
Voice Coil: 1 inch Aluminum Former
Impedance: 8 ohms
Free Air Resonance: 230 $H_z$
Sensitivity: 91.5 dB SPL for 1 watt, 1M
Power Handling: 100 watts with 500 $H_z$ crossover In side panel 11, the panel facing the listening room corner side wall, as can best be seen by reference to FIG. 1 of the drawing, is located driver 16, a so-called "woofer" for reproduction of the low frequency sounds. Quite surprising performance can be had, as discovered in the practice of the invention, provided the drivers are located on the enclosure as set forth, with use of a driver of very small dimension, i.e., a 5" woofer, having a sound pressure frequency range of between 50–4000 $H_z$. The performance requirements of the invention have been met quite satisfactorily with the use of a Peerless K050 WG driver, a driver, as are those indicated above, available commercially from Peerless Audio Manufacturing Corp., Leominster, Mass. As indicated by the manufacturer, this bass driver is further characterized by the following specifications:

Magnet: 9 oz. ceramic
Voice Coil: 1 inch Aluminum Former
Impedance: 8 ohms nom.
Free air resonance: 45 $H_z$
Sensitivity: 88.5 dB SPL for 1 watt, 1M
Power Handling: 40 watts With the combination of drivers set forth, and in the speaker enclosure described herein, good sound reproduction will be found over the complete sound spectrum. Although, as set forth above, excellent performance is achieved in the practice of the invention with the specifically indicated drivers, it will be appreciated that other drivers can be used in its practice, provided equivalent sound reproduction and performance is obtained. The critical features of the invention depend, as well, upon the location of the drivers in the speaker enclosure, speaker enclosure interior volume, and the use of matched speakers. In the selection of other drivers, however, one should select those drivers with whatever particular characteristics will result in the sound performance provided by those drivers set forth herein and used in the practice of this invention.

Figure 4:
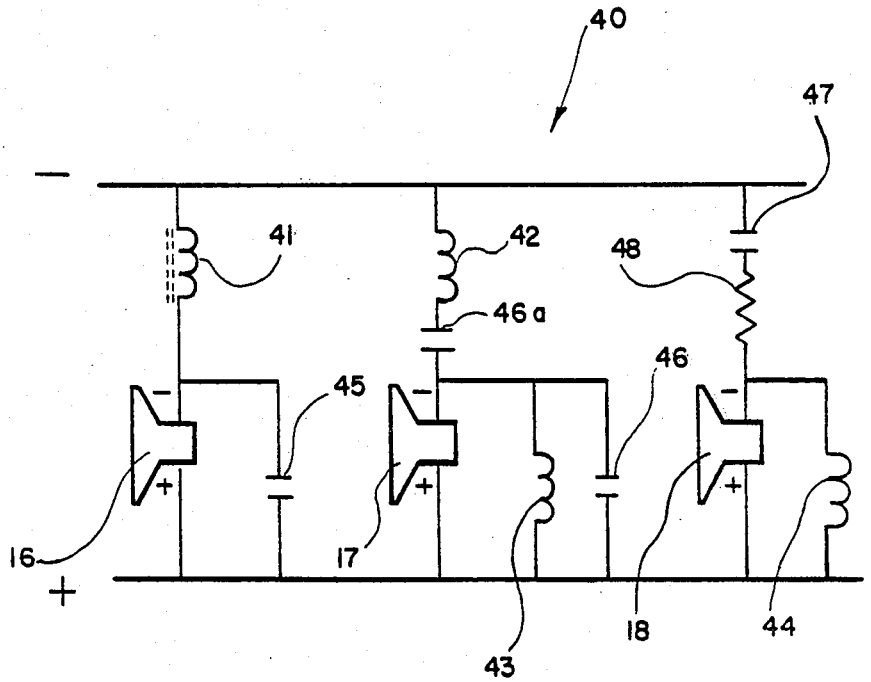
FIG. 4 is a schematic electrical diagram showing the cross-over network of the present invention.

The three drivers, i.e., drivers 16, 17 and 18, are connected together with suitable electrical connections which energize the loudspeakers. As shown schematically in FIG. 4 of the drawing, the drivers are inter-connected together by means of cross-over network 40 which comprises chokes 41 (0.5 mhy), 42 (0.9 mhy), 43 (2.4 mhy) and 44 (0.22 mhy), capacitors 45 (50 v 40 mfd), 46 (50 v 8 mfd), **46*a* (50 v 20 mfd) and 47 (50 v 4 mfd); and a 2.7 ohm resistor (5% wire wound ceramic) 48, all of which are available commercially. Thus, low frequency driver 16, as is customary with low frequency drivers, is choked off so that it will not produce signals above a certain cut-off frequency, in this case, above about 500 cycles. And, mid-range driver 17 cuts in at about 500 cycles. Tweeter 18 cuts in at about 4000 cycles while, at the same frequency, the mid-range driver cuts out. Resistor 48, as will be appreciated, protects tweeter 18** and reduces power input to it, to its normal level of operation.

The wiring of the cross-over network 40 is located inside, i.e., in the cavity of the speaker enclosure, with terminals exiting through an opening provided in bottom planar panel 15. As usual, sufficient wiring is provided for connection at the amplifier.

The speaker enclosure of the invention can be constructed of any natural wood, e.g., ¾" walnut, pine or their equivalent, so long as the internal volume determined in the practice of the invention to be critical is substantially maintained. In practice, in the enclosure of FIG. 1, side panels 11, 12 were of ¾" walnut and each measured 13.88-inches×6-inches (inside dimensions); front panel 13 measured (inside dimension) 20.34-inches×6-inches. Top and bottom panels 14, 15 also of ¾-inch walnut each measured 22.34×15.88×15.88. Thus, the interior volume of speaker enclosure 10 is 0.334 $ft^3$ (577 $in^3$).

On the bottom surface of bottom panel 15 are, as shown in FIG. 3, provided feet 31, 32 and 33, located near the three corners of the bottom panel. Thus, with these feet the bottom surface of bottom panel 15 of the speaker enclosure is located only ½-inch off the listening room floor. In all, speaker enclosure 10 is only 8-inches off the floor, providing a low, compact, unobtrusive speaker system.

Turning now to FIG. 5 of the drawing, there is shown therein loud speakers 10, 10', constituting matched pairs, i.e., right and left speakers in accordance with the invention, placed exactly in the corners of the listening room at the ends of a common wall, except that drivers 16 and 17 are located approximately 4 inches away from the corner walls which each faces. The speakers are of exactly the same construction except that they are mirror images with respect to the location of low frequency driver 16. These drivers must always, for performance as set forth herein, face towards the side walls of the listening room. The mid-range drivers 17 in each of the two speakers face toward the rear or back wall of the listening room, assuming a listener is located at the center of the room and facing the wall between the two speakers. Thus, these respective walls will be used to reflect the sounds produced into the listening room, contrary to the tweeter which faces directly outwardly into the room.

Figure 6:
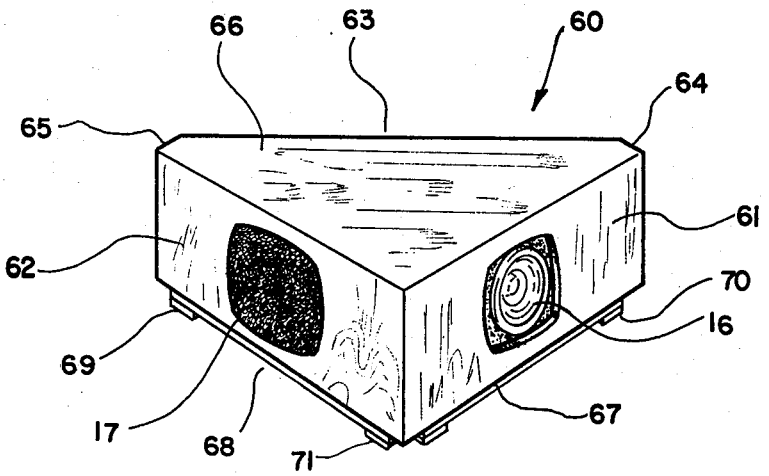
FIG. 6 is a view in perspective of a further embodiment of a speaker enclosure of the invention.
Figure 7:
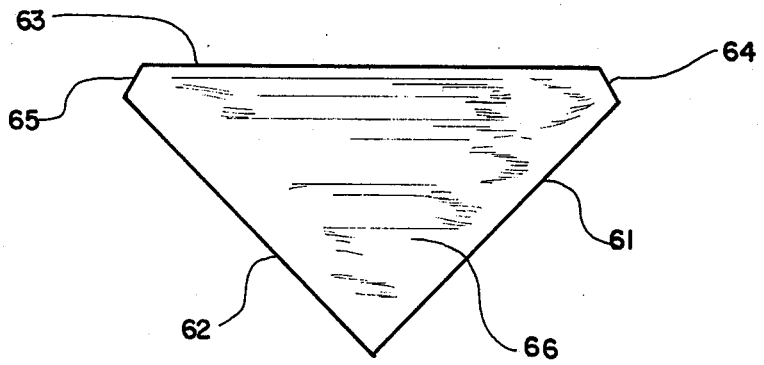
FIG. 7 is a top plan view of the speaker enclosure shown in FIG. 6.

A further, and sometimes more desirable, construction of speaker enclosure is disclosed in FIG. 6 of the drawing, the speaker enclosure being referred to generally therein by reference numeral 60. As indicated, speaker enclosure 60 comprises vertically disposed planar first and second side panels 61, 62 which intersect with one another at a 90° angle and a vertically disposed planar front panel 63 which would intersect the side panels at an angle of 45°, but for vertically disposed planar end panels 64, 65. The speaker enclosure is completed, providing a pre-determined interior volume of approximately 0.335 $ft^3$ by means of planar top and bottom panels 66, 67. As shown in FIG. 6 of the drawing, speaker enclosure 60 can be, if desired, provided with planar sub-base 68 of the same shape as bottom panel 67 but of somewhat lesser over all dimensions, bottom panel 67 thereby providing a slight overhang equally around the bottom panel perimeter. At each of the corners of sub-base 68 are provided commercially available plastic feet ($\frac{1}{4}$") 69, 70, 71. While the performance provided with either speaker enclosure disclosed herein is the same, speaker enclosure 60 is the preferred design as the planar end panels 64, 65 provides an enclosure less susceptible to damage. Although, as shown in the drawing, end panels 64, 65 diverge slightly with respect to one another and with respect to their intersection with front panel 63, it will be appreciated that this need not necessarily be the case. These two panels can, if desired, be parallel to one another, the imaginery line dividing the right angle formed by the side panels laying mid-way between them and dividing the front panel into two equal sections.

In the practice of the invention, drivers 16, 17 and 18 are mounted, as in the speaker construction disclosed in FIG. 1 centrally of the vertically disposed panels. Contrary to the construction of FIG. 1, however, the drivers are somewhat recessed allowing the foam grille face 72 to be flush with side panel 62. It will be appreciated that, although not shown, similar foam grille faces are provided on each of the driver faces. Rather than covering the entire side panel as shown in FIG. 5, however, the foam grille in the construction of FIG. 6 is located only in front of the driver. Thus, as the foam grille is flush with and of the same color as the side panel the appearance of a continuous wooden side panel is affected. As before disclosed, any wood desired can be used in the practice of the invention, $\frac{3}{4}$" inch plywood/walnut veneer being found quite satisfactory. In this case side panels 61, 62 each measured $14\frac{1}{4}$"×6", front panel 63 measured $18\frac{7}{8}$"×6", and end panels 64, 65 measured 2"×6". The top and bottom panels 66, 67 measured $18\frac{5}{8}$" along the front edge and $14\frac{1}{4}$" on each side edge. Sub-base 68 was of $\frac{1}{4}$ inch plywood measuring about one inch less each dimension than bottom panel 67. Thus, the overall height of enclosure 60 from the floor is only $6\frac{1}{2}$ inches, counting the $\frac{1}{4}$" feet provided at the corners of the sub-base,. This is of extremely low height for a speaker and with the tweeter located so close to the floor a truly unique speaker system of unexpectedly good performance.

It will be appreciated that in order for the height of the previously disclosed speaker enclosure to be kept to its height of only $6\frac{1}{2}$" off the floor, the top and bottom panels are recessed into the enclosure formed by the vertically disposed side panels. And, in turn, the drivers and their mounts are recessed as needed in the side and top and bottom panels.

In use, the effect of spaciousness achieved by the design of the speaker system of this invention is very striking. The speakers deliver room filling sound to the listening room of the highest fidelity and with excellent stereo imagery.

It should be understood that the embodiments described herein are merely exemplary of the preferred practice of the present invention and that various modifications and changes may be made in the arrangements and details of construction of the particular embodiments described herein without departing from the spirit and scope of the present invention.

The embodiments of the invention in which an exclusive property or privilege is claimed are defined as follows:

1. A loud speaker system suitable for exact placement in the corners of a listening room comprising a triangular-shaped speaker enclosure comprising first and second vertically disposed planar side panels intersecting one another at a 90° angle, and a vertically disposed planar front panel intersecting with said first and second side panels and subtending angles of 45°, a woofer for low frequency reproduction in one of said first and second side panels, a tweeter for high frequency sound reproduction in said front panel, and a mid-range driver which reproduces the frequencies between the woofer and tweeter in the other of said first and second side panels, and a three-way electronic cross-over network.

2. A loud speaker system suitable for exact placement in the corners of a listening room according to claim 1 wherein the said triangular-shaped enclosure further comprises bottom and top triangular-shaped planar panels for providing an interior cavity of predetermined volume.

3. A loud speaker system suitable for exact placement in the corners of a listening room according to claim 2 wherein the interior volume of said speaker enclosure is about 0.334 cubic feet.

4. A loud speaker system suitable for exact placement in the corners of a listening room according to claim 3 wherein said front panel is of $\frac{3}{4}$-inch natural wood and its inside dimensions are approximately 6-inches×20.34; and the said first and second panels are of $\frac{3}{4}$-inch natural wood whose inside dimensions are approximately 6-inches×13.88-inches, respectively.

5. A loud speaker system suitable for exact placement in the corners of a listening room according to claim 4 wherein said bottom and top triangular-shaped panels measure about 22.34-inches along the hypotenuse and about 15.88-inches along the sides, respectively, providing an overhang with respect to the said vertically disposed panels and a foam grille mounted to said panels co-extensive with the dimensions of the said side panels and flush with the edges of the top and bottom panels.

6. A loud speaker system suitable for exact placement in the corners of a listening room according to claim 5 wherein the bottom planar surface of said bottom panel is located only about $\frac{1}{2}$-inch off the floor.

7. A loud speaker system suitable for exact placement in the corners of a listening room according to claim 6 wherein the top planar surface of said top panel is no more than about 8-inches off the floor.

8. A loud speaker system suitable for exact placement in the corners of a listening room according to claim 1 wherein the woofer is a 5-inch bass driver.

9. A loud speaker system suitable for exact placement in the corners of a listening room according to claim 1 wherein the high frequency tweeter is a one-inch voice coil driver.

10. A loud speaker system suitable for exact placement in the corners of a listening room according to claim 1 wherein the mid-range speaker is a 4-inch driver.

11. A loud speaker system suitable for exact placement in the corners of a listening room according to claim 1 wherein the woofer operates through its full frequency range, the mid-range driver is connected so as to cut in at about 500 hertz and operates through its full frequency range, and the high frequency speaker is connected so as to cut in at 4000 hertz and operates through its full high frequency range, while the mid-range driver cuts out at the same frequency.

12. A loud speaker system suitable for exact placement in the corners of a listening room according to claim 1 wherein the cross-over network consists of an inductor in series with the woofer and a capacitor in parallel with the woofer, an inductor in series with a capacitor in series with the mid-range driver and an inductor in parallel with a capacitor in parallel with the mid-range driver, a capacitor in series with a resistor in series with the tweeter and an inductor in parallel with the tweeter.

13. A loud speaker system suitable for exact placement in the corners of a listening room according to claim 1 wherein the said system comprises matched pairs of left and right triangular-shaped speaker enclosures according to claim 1 and the said matched pairs are suitable for placement in corners at opposite ends of the same wall of the listening room, the woofer in each of said speaker enclosures being located in respective first and second panels of the speaker enclosure as to face oppositely located walls of the listening room when the speaker enclosures are positioned in the room corners.

14. A loud speaker system suitable for exact placement in the corners of a listening room according to claim 1 wherein the woofer reproduces the frequencies between 50–4000 $H_z$, the mid-range driver reproduces the frequencies between 500–5000 $H_z$, and the tweeter reproduces the frequencies between 1500–20,000 $H_z$.

15. A loud speaker system suitable for exact placement in the corners of a listening room according to claim 1 wherein the drivers are centrally mounted in their respective panels and in recessed locations, and a foam grille is provided over the face of each driver, said grille being flush with the outside planar surface of the said panels.

16. A loud speaker system suitable for exact placement in the corners of a listening room according to claim 15 wherein the speaker enclosure further comprises vertically disposed planar end panels at the intersection between the said front panel with said side panels.

* * * * *

UNITED STATES PATENT AND TRADEMARK OFFICE

CERTIFICATE OF CORRECTION

PATENT NO. : 4,348,552

DATED : September 7, 1982

INVENTOR(S) : Ralph R. Siccone

It is certified that error appears in the above-identified patent and that said Letters Patent are hereby corrected as shown below:

In the title delete "DIRECT/REFLECTING".

Column 1, line 8, delete "direct/reflecting".

Column 2, lines 22-23, delete "direct/reflecting".

Lines 47-48, delete "direct/reflected sound".

Signed and Sealed this

*Thirteenth* Day of *September 1983*

[SEAL]

*Attest:*

GERALD J. MOSSINGHOFF

*Attesting Officer*

*Commissioner of Patents and Trademarks*